US008092362B2

(12) United States Patent
Kohlstette et al.

(10) Patent No.: US 8,092,362 B2
(45) Date of Patent: Jan. 10, 2012

(54) SEPARATOR ARRANGEMENT IN SANITARY DESIGN

(75) Inventors: Werner Kohlstette, Oelde (DE); Olaf Müller, Gütersloh (DE); Thomas Homann, Gütersloh (DE)

(73) Assignee: Westfalia Separator AG, Oelde (DE)

( * ) Notice: Subject to any disclaimer, the term of this patent is extended or adjusted under 35 U.S.C. 154(b) by 310 days.

(21) Appl. No.: 12/282,424

(22) PCT Filed: Mar. 7, 2007

(86) PCT No.: PCT/EP2007/052120

§ 371 (c)(1),
(2), (4) Date: Jun. 3, 2009

(87) PCT Pub. No.: WO2007/104684

PCT Pub. Date: Sep. 20, 2007

(65) Prior Publication Data

US 2009/0253565 A1 Oct. 8, 2009

(30) Foreign Application Priority Data

Mar. 15, 2006 (DE) ..... 10 2006 011 895

(51) Int. Cl.
*B04B 7/02* (2006.01)
*B04B 9/14* (2006.01)

(52) U.S. Cl. ..... 494/82; 494/38; 494/60; 494/83

(58) Field of Classification Search ..... 494/1, 12, 494/16, 20, 82–84, 14–15, 60–61, 38–41; 68/23.1, 23.3; 464/180; 210/144, 363; 74/572, 74/574

See application file for complete search history.

(56) References Cited

U.S. PATENT DOCUMENTS

| | | | | |
|---|---|---|---|---|
| 2,448,196 | A * | 8/1948 | Shee | 494/46 |
| 2,827,229 | A | 3/1958 | Blum | |
| 3,606,143 | A * | 9/1971 | Stallmann | 494/39 |
| 4,079,882 | A * | 3/1978 | Mizuyoshi et al. | 494/60 |
| 4,099,667 | A * | 7/1978 | Uchida | 494/7 |
| 4,193,536 | A * | 3/1980 | Kubota | 494/14 |
| 4,226,669 | A * | 10/1980 | Vilardi | 159/6.1 |
| 4,457,745 | A * | 7/1984 | Broker et al. | 494/15 |
| 4,769,133 | A | 9/1988 | Brookes et al. | |
| 5,343,282 | A | 8/1994 | Kazaki et al. | |
| 5,582,726 | A | 12/1996 | Feller et al. | |

(Continued)

FOREIGN PATENT DOCUMENTS

DE 28 40 948 A1 3/1979

(Continued)

*Primary Examiner* — Charles E Cooley
(74) *Attorney, Agent, or Firm* — Barnes & Thornburg LLP

(57) ABSTRACT

A separator arrangement includes a separator having a drum with a vertical rotation axis. The drum is placed on a rotatable drive spindle and is surrounded by a shroud. A separating wall separates the separator arrangement into a sanitary area that includes the drum and the shroud and a drive area that includes the drive device. The separator and the drive device are decoupled as a unit, in terms of vibration, by at least one of the separating wall and a foundation attachment. The drive device includes a motor, a coupling, at least one bearing device, and a flange section around the drive spindle underneath a drive cover, and a sealing device. A membrane arrangement is formed in a region of the drive cover and, for vibration purposes, decouples the drive cover from the machine frame in a region around the drive spindle.

17 Claims, 1 Drawing Sheet

U.S. PATENT DOCUMENTS

| | | | | |
|---|---|---|---|---|
| 5,848,959 | A * | 12/1998 | Droste et al. | 494/15 |
| 6,960,158 | B2 | 11/2005 | Mackel | |
| 6,988,980 | B2 * | 1/2006 | Moss | 494/15 |
| 7,168,571 | B2 | 1/2007 | Gerteis et al. | |
| 7,794,383 | B2 * | 9/2010 | Tetsu et al. | 494/7 |
| 7,850,590 | B2 * | 12/2010 | Mackel et al. | 494/14 |
| 2004/0142808 | A1 | 7/2004 | Mackrl | |
| 2005/0065010 | A1 * | 3/2005 | Moss | 494/15 |
| 2006/0175245 | A1 | 8/2006 | Gerteis et al. | |
| 2009/0253565 | A1 * | 10/2009 | Kohlstette et al. | 494/12 |

FOREIGN PATENT DOCUMENTS

| | | | |
|---|---|---|---|
| DE | 36 22 886 | A1 | 1/1987 |
| DE | 43 14 440 | C1 | 6/1994 |
| DE | 43 42 471 | C1 | 5/1995 |
| DE | 103 11 997 | A1 | 10/2004 |
| EP | 311791 | A2 * | 4/1989 |
| JP | 4-190863 | | 7/1992 |
| JP | 8-24714 | | 1/1996 |
| JP | 9-10631 | | 1/1997 |
| WO | WO 02/096566 | A1 | 12/2002 |

* cited by examiner

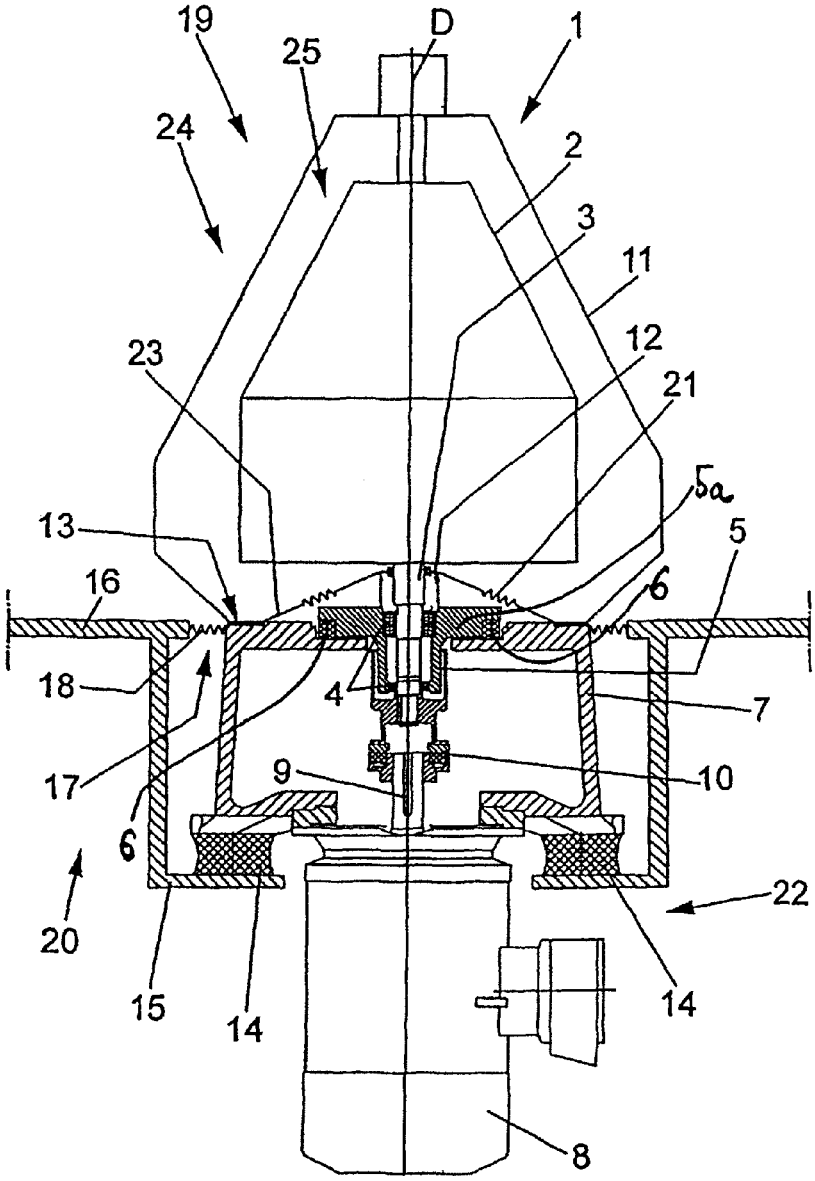
19
D
1
25
24
2
3
11
12
23
21
5a
13
5
16
6
18
4
7
17
9
10
6
22
20
15
14
14
8

SEPARATOR ARRANGEMENT IN SANITARY DESIGN

BACKGROUND AND SUMMARY

The present disclosure relates to a separator arrangement. The separator arrangement includes a separator having a drum with a vertical rotation axis. The drum is placed on a rotatable drive spindle and is surrounded by a shroud. The drum is rotatable during operation by a drive device at a rotation speed of more than 1000 rpm but less than 8500 rpm.

Separator arrangements such as these are known. WO 02/096 566 A1, for example, represents relevant prior art.

DE 43 42 471 C1 and DE 103 11 997 A1 relate to filter centrifuges. U.S. Pat. No. 5,343,282 discloses a laboratory centrifuge.

For various applications of separators, for example, in the field of medicine or foodstuffs, it is necessary to operate separators of a generic type as noted above so as to comply with particularly stringent sanitary and hygiene requirements.

The present disclosure relates to a separator arrangement which complies with these requirements using physically simple means.

The present disclosure relates to a separator arrangement including a separator having a drum with a vertical rotation axis. The drum is placed on a rotatable drive spindle and is surrounded by a shroud. The drum is configured to be rotated during operating by a drive device at a rotation speed of more than 1000 rpm, or more than 2500 rpm, but less than 8500 rpm. The separator arrangement includes a separating wall which separates the separator arrangement into a sanitary area including the drum and the shroud and into a drive area including a drive device. The separator, which includes a machine frame with the shroud and the drum, and the drive device are decoupled as a unit, in terms of vibration, by the separating wall and possibly a foundation attachment.

An arrangement of the components of the separator arrangement is selected such that work to be done on the drive device, such as work on a motor, coupling, spindle, bearing and other maintenance and repair work, can be carried out on the components of the drive device in the drive area without having to make any connection to the sanitary area.

As an example, this arrangement of components allows a lubricant change or motor replacement to be carried out in a simple manner. Conversely, it is possible to work on the shroud or the drum in the sanitary area without having to make any connection to the drive area.

In contrast to DE 36 22 886 A1 and JP 08-024714 A, which disclose centrifuges which are designed to remove fission products from dissolved core fuel, and in which the drive and the drum are separated from one another by a concrete cover, in order to shield the drive from radiation, the present disclosure advantageously provides for the entire separator, together with the machine frame, to be decoupled, in terms of vibration, by the separating wall. In addition, the drum can also advantageously be decoupled, in vibration terms, from the machine frame.

The sanitary area is arranged above the separating wall, and the drive area under the separating wall.

The present disclosure, for example, can be implemented in a simple manner by the sanitary area and the drive area being two areas of a building which are separated from one another and surrounded by the separating wall in the form of a ceiling.

The sanitary area is itself subdivided into a first sanitary region outside the shroud and a second sanitary region inside the shroud. It is, for example, generally sufficient for the first sanitary region outside the shroud to be subject to less stringent cleanliness requirements than the second sanitary region inside the shroud, which may even be in the form of a sterile region. In order to comply with such stringent cleanliness requirements, it is advantageous for the region around the shroud also to be designed to be sanitary, and not to allow any contamination from the drive area to enter the region or area around the shroud.

Vibration decoupling of the separating wall from the machine frame, with its walls, has an advantageous effect which can be achieved via sealing, flexible connecting elements such as a membrane.

Other aspects of the present disclosure will become apparent from the following descriptions when considered in conjunction with the accompanying drawings.

BRIEF DESCRIPTION OF THE DRAWINGS

The Drawing shows a schematic illustration of a separator arrangement, according to the present disclosure.

The Drawing shows a separator arrangement 1 including a separator having a vertical rotation axis D. The separator includes a drum 2 which is placed on a rotatable drive spindle 3. A product to be separated may be, for example, supplied from above, or at the top as one views the Drawing (not shown).

The drive spindle 3 is mounted rotatably in a bearing housing 5 by one or more bearings 4. The bearing housing 5 is supported on an upper flange section **5*a* via elastic elements 6 on a machine frame 7**.

The drive spindle 3 can be rotated with the aid of a motor 8 whose output-drive shaft 9 is arranged as an axial extension of the drive spindle 3. A coupling device 10 is arranged between the drive spindle 3 and the output-drive shaft 9 of the motor 8. The separator arrangement 1, according to the present disclosure, can be, for example, implemented advantageously in a compact form, as shown in the Drawing. The motor 8 is arranged entirely or partially under the machine frame 7. It is within the scope of the present disclosure, for example, to achieve a compact design, for the motor 8 to be arranged inside the machine frame 7, and for the motor 8 and the drum 2 to have a common bearing (not shown).

The drum 2 is surrounded by a shroud 11 which is connected in a firm and gas-tight manner to the machine frame 7 in a lower region 13 of shroud 11. It is within the scope of the present disclosure that a trap for solids can also be connected between the shroud 11 and the machine frame 7.

Overall, a sanitary region 25 within the shroud 11 is sealed in a gas-tight manner from another sanitary region 24 surrounding the shroud 11 and from a drive area 20. This makes it possible to design region 25 to be sanitary. Furthermore, the region 24 outside the shroud 11 is also designed to be gas-tight with respect to the drive area 20, under a separating wall 16, for which purpose suitable precautions must be taken.

A drive cover 23 is formed between the region 13 on which the shroud 11 is fixed to the machine frame 7 and the drive spindle 3. The drive cover 23 is sealed by a sealing device 12 with respect to the drive spindle 3. By way of example, this sealing device 12 may be in the form of a sliding-ring seal or a barrier chamber. The barrier chamber may have two seals which are at a distance from one another and between which a fluid such as a gas can be introduced, which may be a sterile gas. The gas pressure in the barrier chamber is then kept higher than in adjacent areas in the various operating states.

A membrane arrangement 21 is formed on the drive cover 23 between the sealing device 12 and the region 13 in which the shroud 11 is arranged on the machine frame 7. The membrane arrangement 21 decouples the machine frame 7, in terms of vibration, from the spindle 3 and the sealing device 12.

The entire separator, that is to say the machine frame 7 with the shroud 11 and the drum 2, together with drive device 22, is supported via at least one or more elastic supporting elements 14. The elastic supporting elements 14 have damping characteristics which act on a lower foundation attachment 15 of a separating wall 16. The separating wall 16 is shown as being in the form of a flat wall which separates, for example, a building area in which the separator is arranged into a sanitary area 19, which complies with the stringent sanitary requirement above the separating wall 16, and drive area 20 under the separating wall 16.

The sanitary area 19 and the drive area 20 may be, for example, two areas of a building which are separated from one another and surrounded by the separating wall 16 in the form of a ceiling.

Since the machine frame 7 is supported via elastic elements 14 on the lower foundation attachment 15 of the separating wall 16, it is advantageously decoupled, in terms of vibration, from the separating wall 16.

The sanitary area 19 is subdivided into first sanitary region 24 above the separating wall or ceiling 16 and outside the shroud 11, and into second sanitary region 25 inside the shroud 11 and above the drive cover 23. It is within the scope of the present disclosure for the second sanitary region 25 to be designed to be sterile, with the entire area inside the shroud 11 being designed such that it can be steam-sterilized. The temperatures used may be above 120° C., corresponding to a pressure of 1 bar (overpressure). Higher temperatures and pressures can also be provided, for example 134° C./2 bar, with the design of the separator arrangement 1 components being selected appropriately. This makes it possible to produce sterile regions or clean areas or very clean areas, corresponding to the normal specialist use of these terms.

A gap 17 is formed between the separating wall 16 and the machine frame 7 and gap 17 is closed by a elastic sealing element 18 in the form of a membrane. This is to allow relative movements between the separating wall 16 and the machine frame 7. The sealing element 18 closes the drive area 20 off from the sanitary area 19 in an air-tight manner, in such a way that no germs can pass through or dirt/contamination can enter the sanitary area 19.

All of the power and the oil supply from the drive or motor 8 is provided in the drive area 20 under the separating wall 16. Separator arrangement 1 is designed such that there is no need to make any connection between the sanitary area 19 and the drive area 20 even for maintenance tasks. The drum 2 and shroud 11 can therefore be removed on their own from the sanitary area 19. That is so because, according to an embodiment of the present disclosure, all the elements for fixing or working on selected components of separator arrangement 1 are accessible from the sanitary area 19.

The drive device 22 comprises the motor 8, the coupling 10, and the bearing device 4, as well as the lower region 13 of the drive spindle 3 below the sealing device 12. A region inside the machine frame 7 can form an actual drive region via which the bearing 4 is also lubricated.

The separator arrangement 1, as shown in the Drawing, complies with very stringent safety requirements. For example, in the field of medicine, the separator arrangement 1, according to the present disclosure, makes it possible to comply with clean-area or even very-clean-area conditions in region 24.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A separator arrangement comprising:

a separator including a drum having a vertical rotation axis, the drum being placed on a rotatable drive spindle and being surrounded by a shroud, and the drum being rotatable during operation by a drive device at a rotation speed of more than 1000 rpm but less than 8500 rpm;

a separating wall separating the separator arrangement into a sanitary area that includes the drum and the shroud and a drive area that includes the drive device;

wherein the separator, which includes a machine frame, the shroud and the drum, and the drive device are decoupled as a unit, in terms of vibration, by at least one of the separating wall and a foundation attachment;

wherein the drive device includes a motor, a coupling, at least one bearing device, and a flange section around the drive spindle underneath a drive cover, and a sealing device; and wherein a membrane arrangement is formed in a region of the drive cover and, for vibration purposes, decouples the drive cover from the machine frame in a region around the drive spindle.

2. The separator arrangement as claimed in claim 1, wherein the sanitary area is arranged above the separating wall, and the drive area is arranged below the separating wall.

3. The separator arrangement as claimed in claim 1, wherein the sanitary area and the drive area are two areas of a building which are separated from one another and surrounded by the separating wall in the form of a ceiling.

4. The separator arrangement as claimed in claim 1, wherein the sanitary area is subdivided into a first sanitary region outside the shroud and a second sanitary region inside the shroud.

5. The separator arrangement as claimed in claim 4, wherein the first sanitary region outside the shroud is subject to less stringent cleanliness requirements than the second sanitary region inside the shroud.

6. The separator arrangement as claimed in claim 4, wherein the second sanitary region is a sterile region configured to be sterilized by steam.

7. The separator arrangement as claimed in claim 1, wherein the separator, including the machine frame, the shroud and the drum, and the drive unit are supported on one of the separating wall and the foundation attachment by at least one elastic element.

8. The separator arrangement as claimed in claim 1, wherein the drive device includes a motor having an output-drive shaft which is arranged as an axial extension of the drive spindle.

9. The separator arrangement as claimed in claim 1, wherein the shroud is sealed with respect to the drive spindle by a sealing device, which sealing device includes one of a sliding-ring seal and a barrier chamber.

10. The separator arrangement as claimed in claim 1, wherein the drive spindle is mounted rotatably in a bearing housing by at least one bearing device and is supported via elastic elements on the machine frame.

11. The separator arrangement as claimed in claim 1, wherein a coupling device is arranged between the drive spindle and the output-drive shaft of the motor.

12. The separator arrangement as claimed in claim 1, wherein the shroud is connected in a gas-tight manner in a lower region of the shroud to the machine frame.

13. The separator arrangement as claimed in claim 1, wherein a gap is formed between the separating wall and the machine frame and is bridged and sealed by an elastic sealing element.

14. The separator arrangement as claimed in claim 1, wherein the drum and the shroud are configured to be removable from the sanitary area without having to open a connection between the sanitary area and the drive area.

15. The separator arrangement as claimed in claim 1, wherein the drive device includes a motor and the motor is arranged under the machine frame.

16. The separator arrangement as claimed in claim 1, wherein the drive device includes a motor and the motor is arranged inside the machine frame.

17. The separator arrangement as claimed in claim 1, wherein the drive device includes a motor and the motor and the drum have a common bearing.

* * * * *